US006897839B2

(12) United States Patent
Noguchi et al.

(10) Patent No.: US 6,897,839 B2
(45) Date of Patent: May 24, 2005

(54) ACTIVE MATRIX DISPLAY

(75) Inventors: Yukihiro Noguchi, Gifu (JP); Shoichiro Matsumoto, Ogaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 242 days.

(21) Appl. No.: 10/101,627

(22) Filed: Mar. 21, 2002

(65) Prior Publication Data

US 2002/0140686 A1 Oct. 3, 2002

(30) Foreign Application Priority Data

Mar. 27, 2001 (JP) ..... 2001-90043

(51) Int. Cl.[7] ..... G09G 3/36
(52) U.S. Cl. ..... 345/82; 345/95; 345/100
(58) Field of Search ..... 345/82, 89, 95, 345/100, 87, 90

(56) References Cited

U.S. PATENT DOCUMENTS

| | | | | |
|---|---|---|---|---|
| 5,061,920 A | * | 10/1991 | Nelson | 345/89 |
| 5,414,443 A | * | 5/1995 | Kanatani et al. | 345/95 |
| 6,157,361 A | * | 12/2000 | Kubota et al. | 345/100 |
| 6,256,024 B1 | | 7/2001 | Maekawa | |
| 6,384,808 B2 | * | 5/2002 | Azami | 345/100 |
| 6,507,332 B1 | * | 1/2003 | Kuwabara et al. | 345/103 |
| 6,525,567 B2 | * | 2/2003 | Koizumi | 326/82 |
| 6,670,944 B1 | * | 12/2003 | Ishii | 345/100 |
| 2003/0174115 A1 | | 9/2003 | Wasjio et al. | |

FOREIGN PATENT DOCUMENTS

| | | |
|---|---|---|
| JP | 11-085111 | 3/1999 |
| JP | 2000-339984 | 12/2000 |
| JP | 3473745 | 9/2003 |

* cited by examiner

*Primary Examiner*—Guy J. Lamarre
*Assistant Examiner*—Fritz Alphonse
(74) *Attorney, Agent, or Firm*—McDermott Will & Emery LLP

(57) ABSTRACT

An active matrix display capable of reducing power consumption and preventing an operation failure when switching the operation of a level shifter is obtained. In this active matrix display, a level shifter operating in a time-divisional manner is formed by a level conversion circuit converting a signal voltage level, a control circuit generating a control signal deciding an operating period of the level shifter and a switching circuit supplying a power supply voltage to the level conversion circuit in response to the control signal. Thus, the operating period of the level shifter is readily controlled, for stopping operation of an unnecessary circuit part. Consequently, power consumption can be reduced. When the control circuit generating the control signal deciding the operating period of the level shifter is employed for overlapping operating periods of adjacent level shifters, an operation failure such as an inoperable state of a next-stage latch circuit resulting from delay or the like is prevented when switching the operation of the level shifter.

18 Claims, 11 Drawing Sheets

ACTIVE MATRIX DISPLAY

BACKGROUND OF THE INVENTION

1. Field of the Invention

The present invention relates to a display, and more specifically, it relates to an active matrix display having a switching element every pixel.

2. Description of the Prior Art

Displays are roughly classified into a passive matrix display and an active matrix display in general. The active matrix display is provided with a switching element for each pixel, for applying a voltage (or feeding a current) responsive to image data to each pixel thereby making display.

A liquid crystal display (LCD) sealing liquid crystals between opposite substrates applies a voltage to a pixel electrode formed every pixel for varying transmittance for the liquid crystals thereby making display. An active matrix LCD having a high image quality forms the mainstream particularly in application to a monitor.

An electroluminescence (EL) display feeds a current to an EL element from a pixel electrode formed every pixel thereby making display. Active study is made in order to put an active matrix EL display into practice.

Particularly in the so-called low-temperature polysilicon TFT (thin-film transistor) obtained by fabricating a semiconductor layer of a thin-film transistor applied to a switching element without through a high-temperature process, various types of peripheral circuits can be integrally formed on a glass substrate. Therefore, no driving IC may be connected to the periphery, and hence the cost can be reduced. The low-temperature polysilicon TFT can be applied to various active matrix displays such as a plasma display, a field emission display (FED) and an electrophoretic display, in addition to the aforementioned LCD and the aforementioned EL display.

FIG. 13 is a conceptual diagram showing a conventional active matrix LCD. Referring to FIG. 13, an external control circuit 200 is connected to an LCD panel 100 prepared by arranging various types of circuits on a glass substrate in the conventional active matrix LCD.

The external control circuit 200 supplies various control signals, video signals, a power supply voltage $V_{DD}$ etc. to the LCD panel 100, in order to drive the LCD panel 100. The external control circuit 200 formed by a general CMOS circuit operates at a low voltage of 3 V, for example, and outputs control signals of 3 V in amplitude.

A display area 10 and various circuits are arranged on the LCD panel 100. A plurality of pixel electrodes 9 arranged in the form of a matrix, a plurality of signal lines 6 extending in a column direction and a plurality of scanning lines 7 extending in a row direction are arranged on the display area 10. Selection transistors 8 are arranged on the respective intersections between the signal lines 6 and the scanning lines 7. The selection transistors 8 have drain or source electrodes connected to the signal lines 6, gate electrodes connected to the scanning lines 7 and sources connected to the pixel electrodes 9. A primary color filter (not shown) of red, green or blue is arranged in correspondence to each pixel electrode 9, for making color display.

A signal line driving circuit 21 and a scanning line driving circuit 22 are arranged on a column side and a row side of the display area 10 respectively. A step-up circuit 40 is connected between the signal line and scanning line driving circuits 21 and 22 and the external control circuit 200. The step-up circuit 40 is formed by level shifters 41 for increasing voltage levels and buffers 42 improving current drivability. These level shifters 41 and buffers 42 are arranged for control signals to be stepped up respectively. The signal line driving circuit 21 and the scanning line driving circuit 22 are formed by shift registers.

FIG. 14 is a circuit diagram showing the signal line driving circuit 21 and a level shifter group of the conventional active matrix display. Referring to FIG. 14, the signal line driving circuit 21 includes a shift register 23 and a plurality of RGB selection circuits 24 (24*a*, 24*b*, 24*c*, . . . ). The shift register 23 is formed by a plurality of latch circuits 25 (25*a*, 25*b*, 25*c*, . . . ). A horizontal clock HCK supplied from the external control circuit 200 is input in the latch circuits 25 of the respective stages. The RGB selection circuits 24 are formed by triple signal line selection transistors 26 (26Ra, 26Ga and 26Ba, 26Rb, 26Gb and 26Bb, . . . ) having gates connected with outputs of the latch circuits 25. The signal line selection transistors 26 have drains connected to any of video signal lines 300R, 300G and 300B and sources connected to the signal lines 6 (6Ra, 6Ga and 6Ba, 6Rb, 6Gb and 6Bb, 6Rc, 6Gc and 6Bc, . . . ).

Operations of the conventional active matrix display are now described with reference to FIGS. 13 and 14. Referring to FIG. 13, the scanning line driving circuit 22 sequentially selects prescribed scanning lines 7 from the plurality of scanning lines 7 and applies a gate voltage $V_G$ thereto, thereby turning on the selection transistors 8 connected to the scanning lines 7. The scanning line driving circuit 22 selects the first scanning line 7 with vertical start signal VST, while sequentially switching to and selecting subsequent scanning lines 7 in response to a vertical clock VCK.

The signal line driving circuit 21 selects a prescribed signal line 6 from the plurality of signal lines 6 and supplies RGB video signals to the pixel electrodes 9 through the signal line 6 and the selection transistor 8. The signal line driving circuit 21 selects one or a plurality of signal lines 6 at once. The signal line driving circuit 21 selects the first signal line 6 with a horizontal start signal HST, while sequentially switching to and selecting subsequent signal lines 6 in response to the horizontal clock HCK.

The step-up circuit 40 steps up low-voltage clocks VCKL and HCKL of 3 V in amplitude output from the external control circuit 200 to 12 V, for example, thereby generating the aforementioned vertical clock VCK and the aforementioned horizontal clock HCK. Each signal line 6 or each scanning line 7 connected with a large number of pixel electrodes 9 cannot be driven with a low voltage of about 3 V. Therefore, the step-up circuit 40 steps up control signals supplied from the external control circuit 200 to high voltages of 12 V.

Referring to FIG. 14, the horizontal start signal HST is input in the first-stage latch circuit 25*a*. An output of the latch circuit 25*a* receiving the horizontal start signal HST goes high for a period of the cycle of the horizontal clock HCK responsive to the pulse width of the horizontal start signal HST. The signal line selection transistors 26Ra, 26Ga and 26Ba enter ON states due to the output of the latch circuit 25*a* respectively. Thus, video signals are supplied to the signal lines 6Ra, 6Ga and 6Ba from the video signal lines 300R, 300G and 300B respectively. The output of the first-stage latch circuit 25*a* is input in the second-stage latch circuit 25*b*. An output of the latch circuit 25*b* shifts from the output of the latch circuit 25*a* by half the cycle of the horizontal clock HCK and goes high for a desired period. Thus, the video signals are supplied to the signal lines 6Rb, 6Gb and 6Bb from the video signal lines 300R, 300G and 300G. Thereafter outputs of the subsequent latch circuits 25 sequentially go high for sequentially selecting the corresponding signal lines 6 and supplying the video signals to all pixels.

When all signal lines 6 of one row are selected, the vertical clock VCK enters a next cycle and the scanning line driving circuit 22 supplies the gate voltage $V_G$ to the subsequent scanning line 7. The horizontal start signal HST is input again so that the output of the first-stage latch circuit 25*a* goes high.

Recently, requirement for reduction of power consumption for a display is increased following popularization of a portable telephone and a portable information terminal.

In the aforementioned prior art, however, the horizontal clock HCK and the vertical clock VCK are supplied to the shift registers 23 of all stages of the signal line driving circuit 21 and the scanning line driving circuit 22 for driving the same. Therefore, the conventional active matrix display requires large current drivability. Consequently, power consumption is disadvantageously inevitably increased. In particular, the buffers 42 of the step-up circuit 40 for ensuring high current drivability require large power consumption.

In order to solve this problem, a plurality of level shifters connected to at least either the signal line driving circuit 21 or the scanning line driving circuit 22 may be driven in a time-divisional manner. In this case, however, an operation failure may be readily caused when a signal is delayed, for example.

SUMMARY OF THE INVENTION

An object of the present invention is to provide an active matrix display requiring smaller power consumption.

Another object of the present invention is to prevent an operation failure when driving level shifters in a time-divisional manner in the aforementioned active matrix display.

An active matrix display according to an aspect of the present invention comprises a plurality of pixel electrodes arranged in the form of a matrix, a plurality of scanning lines arranged in a row direction, a plurality of signal lines arranged in a column direction, a plurality of switching elements having gate electrodes and drain or source electrodes connected to the scanning lines and the signal lines respectively, a signal line driving circuit sequentially selecting prescribed scanning lines from the plurality of scanning lines and supplying a video signal, a scanning line driving circuit sequentially selecting prescribed scanning lines from the plurality of scanning lines and supplying a scanning signal, and a level shifter group including a plurality of level shifters connected to at least either the signal line driving circuit or the scanning line driving circuit for operating in a time-divisional manner. Each level shifter forming the level shifter group includes a level conversion circuit converting a signal voltage level, a control circuit generating a control signal deciding an operating period of the level shifter, and a first switching circuit supplying a power supply voltage to the level conversion circuit in response to the control signal. According to the present invention, the term "first switching circuit" indicates a wide concept including not only a single switching element rendering wires conductive but also a switching circuit consisting of a plurality of elements.

In the active matrix display according to this aspect, each level shifter operating in the time-divisional manner is formed by the level conversion circuit converting the signal voltage level, the control circuit generating the control signal deciding the operating period of the level shifter and the first switching circuit supplying the power supply voltage to the level conversion circuit in response to the control signal as hereinabove described, whereby the operating period of the level shifter can be readily controlled and the operation of an unnecessary circuit part can be stopped. Thus, power consumption can be reduced. When the control circuit generating the control signal deciding the operating period of each level shifter is employed for overlapping the operating periods of adjacent level shifters, it is possible to prevent an operation failure such as an inoperative state of the next-stage latch circuit caused by delay or the like when switching the operation of the level shifter.

In the active matrix display according to the aforementioned aspect, at least either the signal driving circuit or the scanning line driving circuit has a shift register consisting of a plurality of latch circuits, and a plurality of latch circuits are associatively connected to each level shifter forming the level shifter group. Thus, the number of level shifters connected to at least either the signal line driving circuit or the scanning line driving circuit can be reduced by connecting a plurality of latch circuits in correspondence to each level shifter, whereby the area occupied by the level shifters can be reduced in layout design. In this case, each level shifter forming the level shifter group preferably starts operation before operation initiation of the latch circuits associatively connected thereto and terminates the operation before operation termination of the latch circuits. According to this structure, the next-stage level shifter starts operation when each level shifter terminates its operation, whereby an operation failure such as an inoperative state of the next-stage latch circuit resulting from delay or the like can be prevented when switching the operation of the level shifter.

In the active matrix display having the aforementioned structure connecting the plurality of latch circuits to each level shifter, the control circuit preferably receives output signals from a plurality of latch circuits thereby generating the control signal deciding the operating period of each level shifter forming the level shifter group. According to this structure, no excess signal may be input from an external circuit but the number of terminals connected to the external circuit can be reduced. In this case, the control circuit preferably receives an output signal from a latch circuit preceding the initial-stage latch circuit among a plurality of latch circuits associatively connected to each level shifter forming the level shifter group by at least two stages and an output signal from a latch circuit succeeding the final-stage latch circuit. According to this structure, an operation failure caused by delay or the like can be prevented when switching the operation of the level shifter.

In this case, each level shifter may be provided for five latch circuits, and the control circuit may receive outputs from second- and fourth-stage latch circuits of a block including the level shifter, a fourth-stage latch circuit of a block immediately preceding this block and a second-stage latch circuit of a block immediately succeeding this block. In this case, each level shifter may start operation in response to the output from the fourth-stage latch circuit of the immediately preceding block, maintain the operation in response to the outputs from the second- and fourth-stage latch circuits of the block including the level shifter and terminate the operation in response to the output from the second-stage latch circuit of the immediately succeeding block.

In the aforementioned case, the output signals of the latch circuits input in the control circuit are preferably output signals from the same latch circuits regardless of a scanning direction. According to this structure, the number of input terminals of the control circuit can be reduced, whereby the structure of the control circuit can be simplified.

In the aforementioned case, the control circuit preferably receives output signals from one or a plurality of latch circuits among a plurality of latch circuits associatively connected to each level shifter for maintaining the control signal during the operating period of the level shifter. According to this structure, the control signal can be maintained during the operating period of the level shifter.

In the active matrix display having the aforementioned structure connecting the plurality of latch circuits to each level shifter, the control circuit preferably includes a flip-flop circuit. According to this structure, the control signal for the operating period can be generated with only signals for initiating and terminating the operation of the level shifter as the input signals for the control circuit, whereby the number of transistors forming the control circuit can be reduced. In this case, an ENB signal line for deciding an initial state is preferably connected to the control circuit. Further, each level shifter is preferably provided for five latch circuits, and the control circuit receives outputs from a fourth-stage latch circuit of a block immediately preceding a block including the level shifter and a fourth-stage latch circuit of a block immediately succeeding the block including the level shifter. According to this structure, the operation of the level shifter can be readily initiated or terminated with the outputs of the latch circuits.

In the active matrix display having the aforementioned structure connecting the plurality of latch circuits to each level shifter, the control circuit may include a NOR circuit, a NOT circuit and a NAND circuit.

In the active matrix display according to the aforementioned aspect, at least either the signal line driving circuit or the scanning line driving circuit preferably has a shift register consisting of a plurality of latch circuits, and each latch circuit is preferably connected in one-to-one correspondence to each level shifter forming the level shifter group. According to this structure, only one of all latch circuits forming at least either the scanning line driving circuit or the signal line driving circuit can be operated, whereby power consumption can be remarkably reduced. In this case, each level shifter forming the level shifter group may start operation simultaneously with operation initiation of the latch circuit connected in correspondence thereto and terminate the operation simultaneously with operation termination of the latch circuit. Further, the control circuit may include a NOT circuit and a NAND circuit.

In the active matrix display according to the aforementioned aspect, the level shifter group including the plurality of level shifters operating in a time-divisional manner is preferably connected to both of the signal line driving circuit and the scanning line driving circuit. According to this structure, power consumption can be reduced in both of the signal line driving circuit and the scanning line driving circuit, while an operation failure can be prevented when switching the operation of the level shifter.

The active matrix display according to the aforementioned aspect preferably includes either an active matrix liquid crystal display or an active matrix EL display. According to this structure, an active matrix liquid crystal display or an active matrix EL display capable of reducing power consumption and preventing an operation failure when switching the operation of a level shifter can be provided.

In the active matrix display according to the aforementioned aspect, at least either the signal line driving circuit or the scanning line driving circuit has a shift register consisting of a plurality of latch circuits, and a plurality of latch circuits are preferably associatively connected to each of the level shifters forming the level shifter group, while the active matrix display preferably further comprises a second switching circuit connected to each output from each level shifter to each latch circuit. According to the present invention, the term "second switching circuit" indicates a wide concept including not only a single switching element rendering wires conductive but also a switching circuit consisting of a plurality of elements. When the second switching circuit is so provided as to enter an ON state only when the latch circuit operates, a level-converted signal output from the level shifter is input in the latch circuit only when the latch circuit operates. Thus, the latch circuit operates only when necessary, whereby power consumed by the latch circuit can be reduced. Consequently, power consumption can be further reduced in the overall display.

In the active matrix display according to the aforementioned aspect, the level shifters forming the level shifter group preferably further include a third switching circuit connected to a signal line for supplying a signal from the signal line to the level conversion circuit in response to a control signal from the control circuit. According to the present invention, the term "third switching circuit" indicates a wide concept including not only a single switching element rendering wires conductive but also a switching circuit consisting of a plurality of elements. According to this structure, signals from the signal lines can be captured through the third switching circuit only for a necessary period, whereby the quantity of a charge/discharge current generated when a line supplying a pulse signal to the level conversion circuit intersects with another line, for example, can be reduced. Consequently, power consumption in the overall display can be further reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

Figure 1:
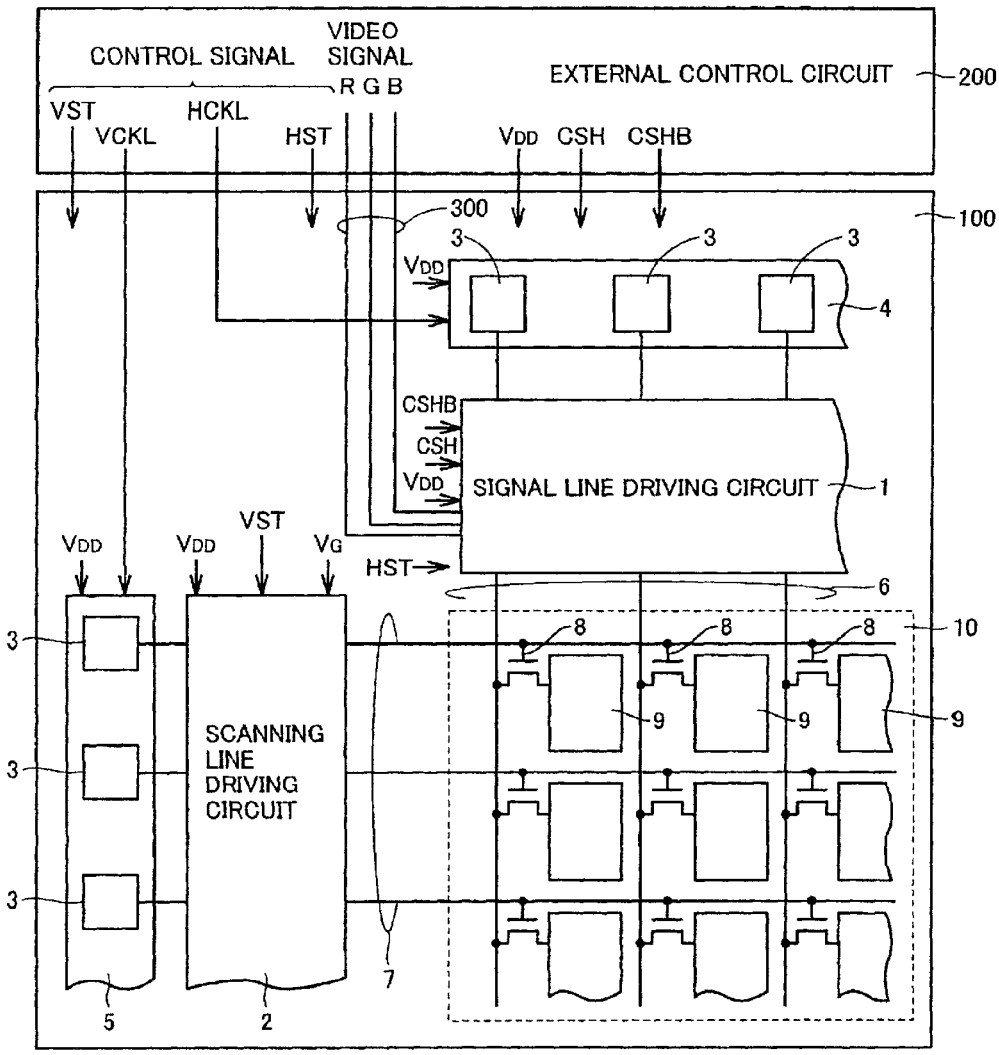
FIG. 1 is a conceptual diagram showing the overall structure of an active matrix display according to the present invention.
Figure 13:
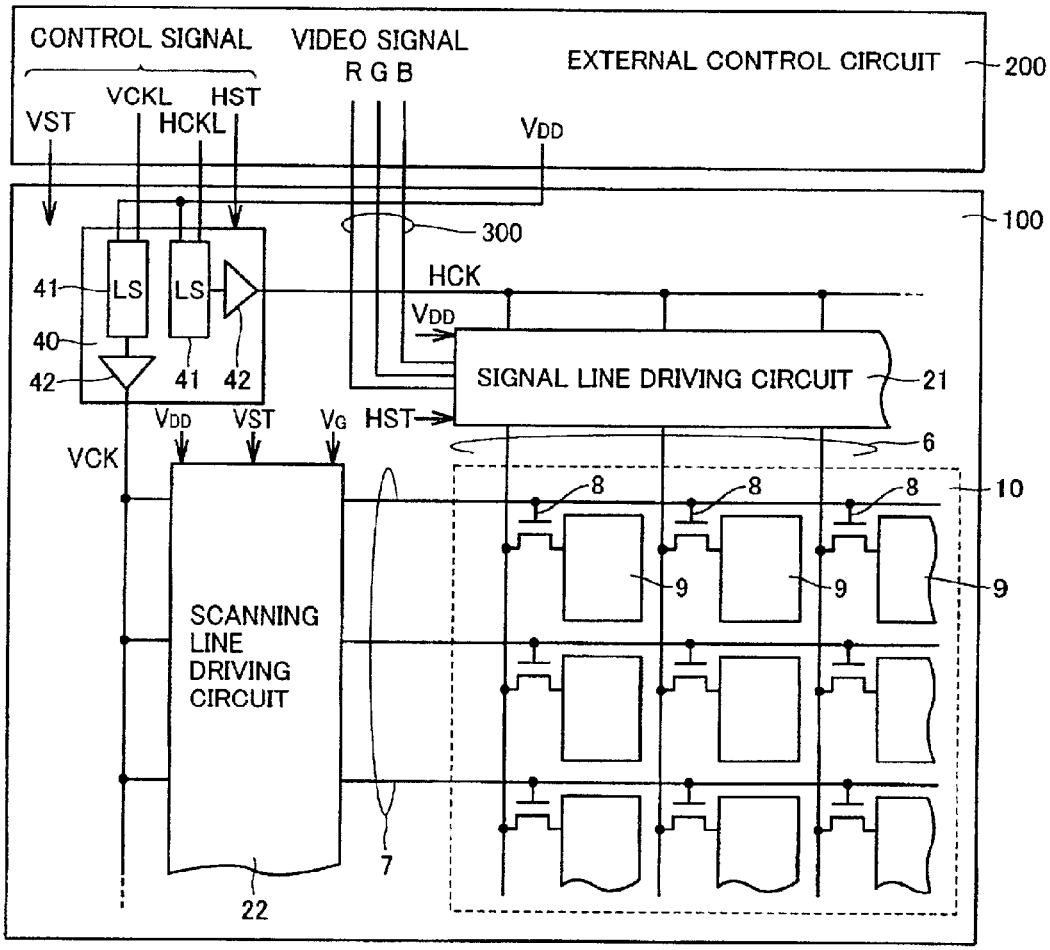
FIG.13 PRIOR ART
FIG. 13 is a conceptual diagram showing a conventional active matrix display.

Referring to FIG. 1, elements similar to those of the conventional display shown in FIG. 13 are denoted by the same reference numerals, to omit redundant description.

In an active matrix display according to a first embodiment of the present invention, an external control circuit 200 and a display area 10 of an LCD panel 100 are absolutely similar in structure to those of the conventional active matrix display.

According to the first embodiment, a signal line driving circuit 1 and a scanning line driving circuit 2 are arranged on sides of the display area 10 respectively.

According to the first embodiment, level shifter groups 4 and 5 are arranged along the signal line driving circuit 1 and the scanning line driving circuit 2 respectively. Each of the level shifter groups 4 and 5 has a plurality of level shifters 3 operating in a time-divisional manner.

The signal line driving circuit 1 and the level shifter group 4 are described in further detail with reference to FIGS. 1 and 2.

The level shifter group 4 is formed by the plurality of level shifters 3 (3*a*, 3*b*, 3*c*, . . . ). The signal line driving circuit 1 has a plurality of latch circuits 11 (11*a* to 11*l*, . . . ), a plurality of RGB selection circuits 12 (12*a* to 12*l*, . . . ) and a plurality of scanning direction selector switches 13 (13*a* to 13*m*, . . . ). The level shifters 3 (3*a*, 3*b*, 3*c*, . . . ) have control circuits 131 (131*a*, 131*b*, 131*c*, . . . ), switching circuits 132 (132*a*, 132*b*, . . . ) consisting of p-channel transistors or the like, and level conversion circuits 133 (133*a*, 133*b*, . . . ). Each switching circuit 132 is an example of the "first switching circuit" according to the present invention.

Each level conversion circuit 133 has a function of converting a signal voltage level. Each control circuit 131 has a function of generating a control signal deciding an operating period of the level shifter 3. Each switching circuit 132 has a function of supplying a power supply voltage $V_{DD}$ to the level conversion circuit 133.

Each level shifter 3 is arranged for five latch circuits 11. Each control circuit 131 receives outputs from second- and fourth-stage latch circuits 11 of a block including the corresponding level shifter 3, a fourth-stage latch circuit 11 of a block immediately preceding this block and a second-stage latch circuit 11 of a block immediately succeeding this block.

Figure 3:
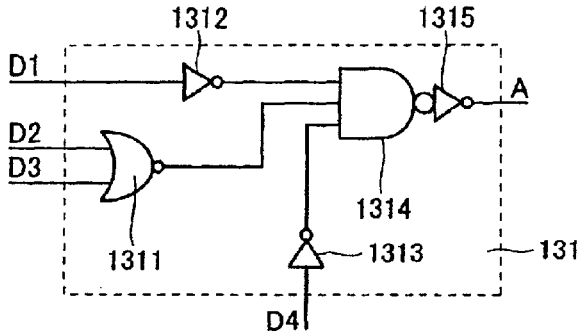
FIG. 3 is a circuit diagram showing the structure of a control circuit of a level shifter according to the first embodiment shown in FIG. 2.

As shown in FIG. 3, each control circuit 131 according to the first embodiment is formed by a NOR circuit 1311, NOT circuits 1312, 1313 and 1315 and a NAND circuit 1314.

The level conversion circuit 133 of each level shifter 3 receives a low-voltage clock HCKL having an amplitude of 3 V supplied from the external control circuit 200. When the switching circuit 132 is turned on, the level conversion circuit 133 is connected to the power supply voltage $V_{DD}$ for level-converting the low-voltage clock HCKL and outputting a horizontal clock HCK.

Figure 14:
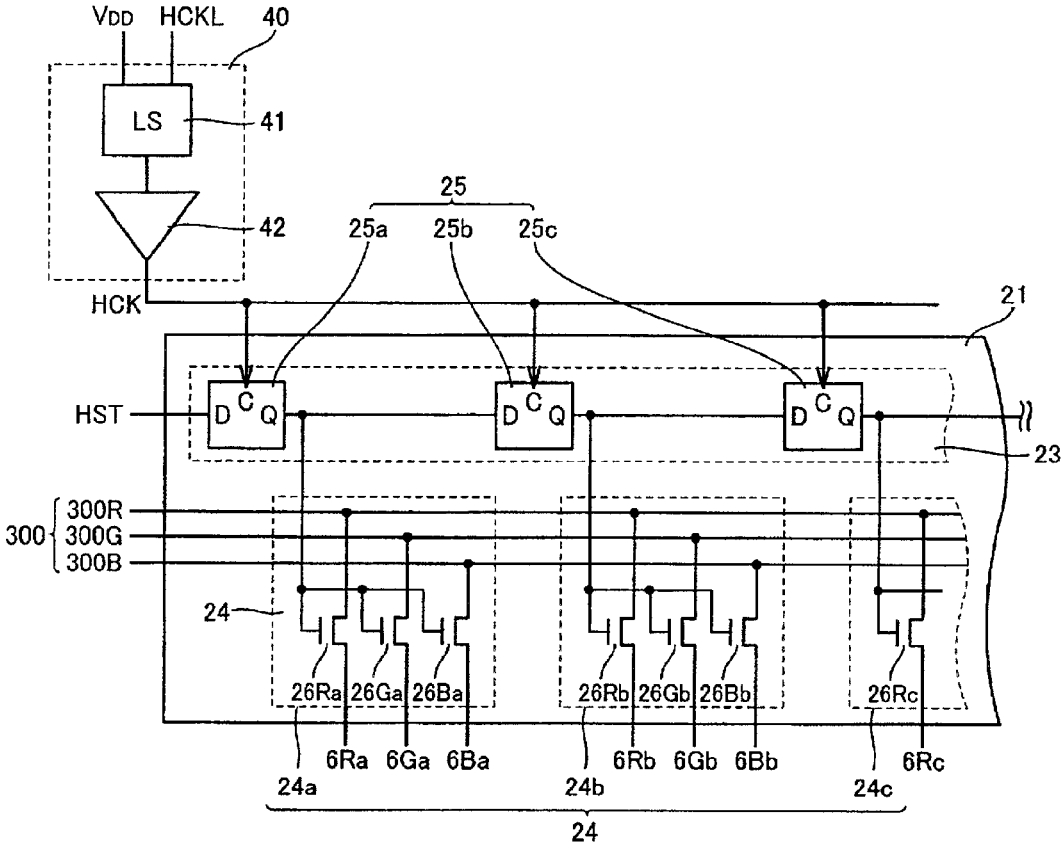
FIG.14 PRIOR ART
FIG. 14 is a circuit diagram showing a signal line driving circuit and a level shifter group in the conventional active matrix display.

An output of each latch circuit 11 is input in the next-stage latch circuit 11 for forming a shift register. The output of the latch circuit 11 is input in the RGB selection circuit 12. The RGB selection circuit 12, absolutely similar to the conventional RGB selection circuit 24 shown in FIG. 14, connects video signal lines 300 and signal lines 6 with each other in response to the output of the latch circuit 11.

Operations of the active matrix display according to the first embodiment are now described with reference to FIGS. 1 to 4. Basic operations of the signal line driving circuit 1 and the scanning line driving circuit 2 are similar to those in the conventional active matrix display. The scanning line driving circuit 2 selects the first scanning line 7 in response to a vertical start signal VST and sequentially switches to subsequent scanning lines 7 in response to a vertical clock VCT for applying a gate voltage $V_G$ thereto. The signal line driving circuit 1 selects the first signal line 6 in response to a horizontal start signal HST and sequentially switches to subsequent signal lines 6 in response to a horizontal clock HCK for supplying video signals thereto.

Figure 2:
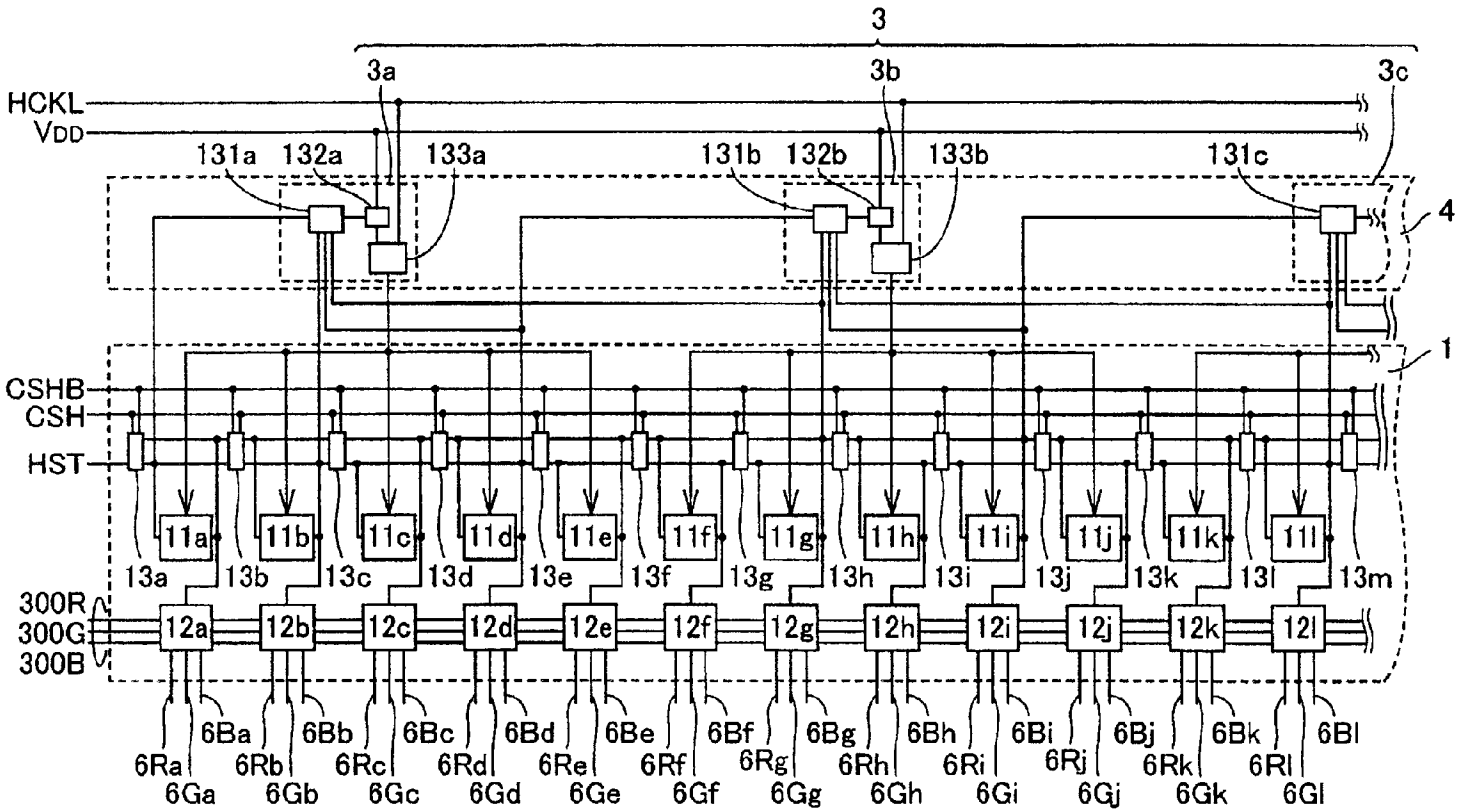
FIG. 2 is a circuit diagram showing a signal line driving circuit and a level shifter group in an active matrix display according to a first embodiment of the present invention.

Referring to FIG. 2, the horizontal start signal HST is input in the first-stage latch circuit 11*a* of the first block and the control circuit 131*a* of the level shifter 3*a* through the scanning direction selector switch 13*a*. The first-stage latch circuit 11*a* is set by the horizontal start signal HST, while an output signal A from the control circuit 131*a* goes low due to an input signal D1 of the latch circuit 11*a* (the start signal HST). Thus, the switching circuit 132*a* is turned on so that the power supply voltage $V_{DD}$ is supplied to the level conversion circuit 133*a*. Consequently, the level conversion circuit 133*a* outputs the level-converted horizontal clock HCK to the latch circuit 11*a*. Thus, the output of the latch circuit 11*a* goes high for a desired period of the cycle of the horizontal clock HCK responsive to the pulse width of the horizontal start signal HST. The RGB selection circuit 12*a* connects video signal lines 300R, 300G and 300B and signal lines 6Ra, 6Ga and 6Ba with each other respectively due to the output of the latch circuit 11*a*. Thus, video signals are supplied to the signal lines 6Ra, 6Ga and 6Ba.

The output of the first-stage latch circuit 11*a* is input in the second-stage latch circuit 11*b* through the scanning direction selector switch 13*b*. The second-stage latch circuit 11*b* is set by the output of the latch circuit 11*a*, and supplied with the horizontal clock HCK. Thus, an output of the latch circuit 11*b* shifts from the output of the latch circuit 11*a* by half the cycle of the horizontal clock HCK and goes high for a prescribed period, so that the video signal lines on the video signal lines 300R, 300G and 300B are supplied to signal lines 6Rb, 6Gb and 6Bb respectively. The output of the second-stage latch circuit 11*b* is input in the control circuit 131*a* of the level shifter 3*a* and the next-stage latch circuit 11*c*. An output signal D2 from the second-stage latch circuit 11*b* input in the control circuit 131*a* maintains the low level of the output signal A from the control circuit 131*a*.

An output of the third-stage latch circuit 11*c* shifts from the output of the latch circuit 11*b* by half the cycle of the horizontal clock HCK and goes high for a prescribed period.

Thus, the video signals are supplied to signal lines 6Rc, 6Gc and 6Bc. The output of the latch circuit 11*c* is input in the fourth-stage latch circuit 11*d*, the output of which shift by half the cycle of the horizontal clock HCK and goes high for a prescribed period. Thus, the video signals are supplied to signal lines 6Rd, 6Gd and 6Bd. An output signal D3 from the latch circuit 11*d* is input in the control circuit 131*a* of the level shifter 3*a*, the fifth-stage latch circuit 11*e* and the control circuit 131*b* of the level shifter 3*b* of the subsequent block.

The signal D3 input in the control circuit 131*a* maintains the low level of the output signal A from the level shifter 3*a*, and the signal input in the control circuit 131*b* starts operation of the level shifter 3*b*. An output of the fifth-stage latch circuit 11*e* shifts by half the cycle of the horizontal clock HCK and goes high for a desired period, so that the video signals are supplied to signal lines 6Re, 6Ge and 6Be. The output of the latch circuit 11*e* is input in the first-stage latch circuit 11*f* of the subsequent block. At this time, the level shifter 3*b* already starts operating and the level-converted horizontal clock HCK is supplied to the latch circuit 11*f*, whereby an output of the latch circuit 11*f* shifts by half the cycle of the horizontal clock HCK without delay and goes high for a prescribed period. Thus, the video signals are supplied to signal lines 6R*f*, 6G*f* and 6B*f*.

The output of the latch circuit 11*f* is input in the second-stage latch circuit 11*g*. An output of the latch circuit 11*g* shifts by half the cycle of the horizontal clock HCK and goes high for a prescribed period, so that the video signals are supplied to signal lines 6Rg, 6Gg and 6Bg. An output signal D4 from the second-stage latch circuit 11*g* is input in the control circuit 131*a* of the level shifter 3*a* of the preceding block, the control circuit 131*b* of the level shifter 3*b* and the third-stage latch circuit 11*h*. When the output signal D4 goes low, the output signal A from the control circuit 131*a* goes high, whereby the switching circuit 132*a* is turned off. Consequently, the operation of the level shifter 3*a* is terminated.

Figure 4:
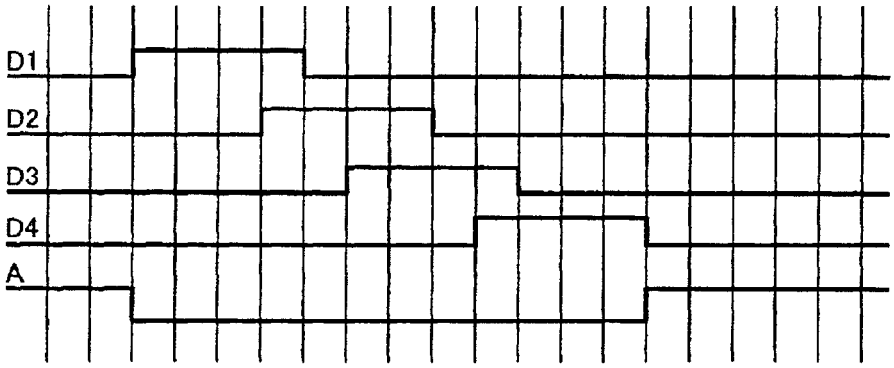
FIG. 4 is a timing chart for illustrating operations of the control circuit according to the first embodiment shown in FIG. 3.

As shown in FIG. 4, the output signal A from the control circuit 131*a* goes low when the signal D1 goes high. The signal D2 goes high before the signal D1 goes low, while the output signal A keeps the low level. Then, the signals D3 and D4 sequentially go high, and the output signal A continuously keeps the low level until the signal D4 goes low. The switching circuit 132*a* is on while the output signal A is low.

On the other hand, the operation of the level shifter 3*b* is maintained. An output of the latch circuit 11*h* shifts from the output of the latch circuit 11*g* by half the cycle of the horizontal clock HCK and goes high for a desired period. Thus, the video signals are supplied to signal lines 6Rh, 6Gh and 6Bh.

Thereafter each latch circuit 11 sequentially outputs a signal shifting in response to the horizontal clock HCK, and supplies the video signals to the signal lines 6R, 6G and 6B. An output of the latch circuit 11 is input not only in the next-stage latch circuit 11 but also in the control circuit 131 of the level shifter 3 as well as the control circuit 131 of the level shifter 3 of the immediately preceding or succeeding block every two stages. Thus, the latch circuit 11 starts, maintains or terminates the operation of the level shifter 3. This operation is repeated for sequentially selecting the signal lines 6 and supplying the video signals to all pixels.

When all signal lines 6 for one row are selected, the vertical clock VCK enters a next cycle so that the scanning line driving circuit 2 supplies the gate voltage $V_G$ to the subsequent scanning line 7 and inputs the horizontal start signal HST again. Thus, the level shifter 3 starts operating so that an output of the first-stage latch circuit 11*a* goes high.

The scanning driving circuit 2 is formed by a shift register. The level shifter group 5 is formed by a plurality of level shifters 3, similarly to the level shifter group 4.

According to the first embodiment, each level shifter 3 is arranged for five latch circuits 11, as hereinabove described. The level shifter 3 starts operating by the output of the fourth-stage latch circuit 11 of the immediately preceding block, maintains the operation by the outputs of the second- and fourth-stage latch circuits 11, and terminates the operation by the output of the second-stage latch circuit 11 of the subsequent block. In other words, the level shifter 3 starts operating before the level shifter 3 of the immediately preceding block terminates its operation, and terminates the operation after the level shifter 3 of the subsequent block starts operating, in a time-divisional manner. Five latch circuits 11 are connected to each level shifter 3 while two level shifters 3 simultaneously operate at the maximum, whereby 10 latch circuits 11 are in operating states at the maximum. Therefore, power consumption can be reduced as compared with the prior art operating the latch circuits 25 of all stages.

The output of each level shifter 3 is supplied to only five latch circuits 11, whereby no high current drivability is required. Thus, the active matrix display according to the first embodiment may not be provided with buffers 42 (see FIG. 13) dissimilarly to the prior art. Therefore, power consumed by such buffers can also be saved.

Further, each level shifter 3 starts operating by the output of the latch circuit 11 preceding the first-stage latch circuit 11 of the block by two stages, whereby the first-stage latch circuit 11 can output the signal without delay.

The control circuit 31 receives the output signals of the same latch circuits 11 regardless of a scanning direction, whereby the number of inputs of the control circuit 131 can be reduced. Thus, the structure of the control circuit 131 can be simplified and the number of wires can be reduced. Consequently, the number of errors in design can be reduced. The scanning direction is switched by supplying complementary signals CSH and CSHB to the scanning direction selector switches 13 (13*a* to 13*m*, . . . ).

Second Embodiment

Figure 5:
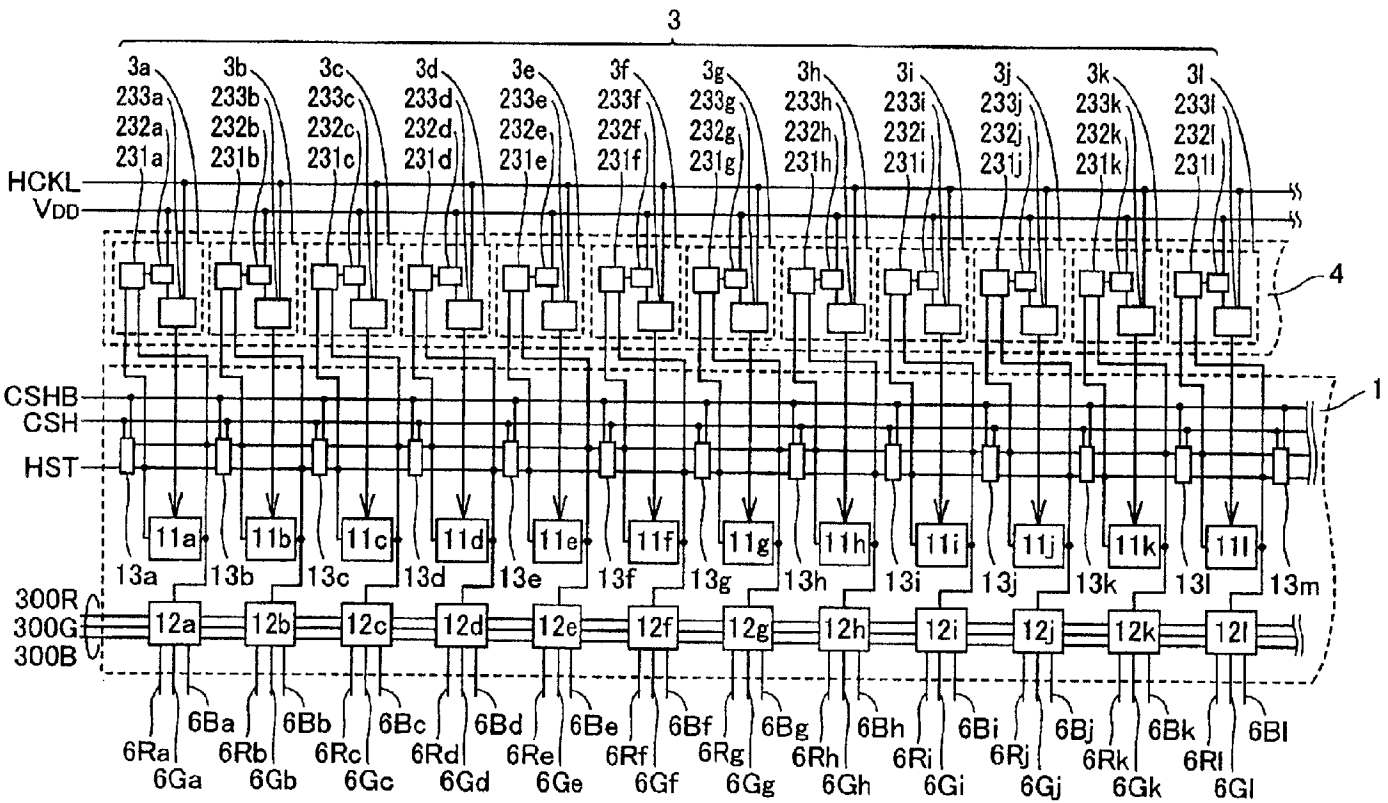
FIG. 5 is a circuit diagram showing a signal line driving circuit and a level shifter group in an active matrix display according to a second embodiment of the present invention.
Figure 6:
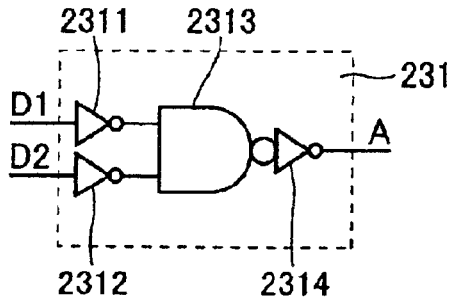
FIG. 6 is a circuit diagram showing the structure of a control circuit of a level shifter according to the second embodiment shown in FIG. 5.
Figure 7:
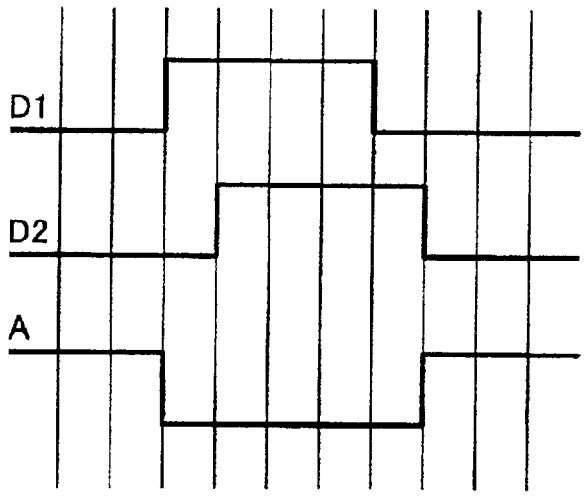
FIG. 7 is a timing chart for illustrating operations of the control circuit according to the second embodiment shown in FIG. 6.

Referring to FIGS. 5 to 7, each level shifter 3 is arranged in one-to-one correspondence to each latch circuit 11 in an active matrix display according to a second embodiment, dissimilarly to the aforementioned first embodiment. The remaining structures and operations of the active matrix display according to the second embodiment are similar to those in the first embodiment, and hence redundant description is omitted.

According to the second embodiment, a level shifter group 4 is formed by a plurality of level shifters 3. A signal line driving circuit 1 has a plurality of latch circuits 11 (11*a* to 11*l*, . . . ), a plurality of RGB selection circuits 12 (12*a* to 12*l*, . . . ) and a plurality of scanning direction selector switches 13 (13*a* to 13*m*, . . . ).

According to the second embodiment, each level shifter 3 is arranged in one-to-one correspondence to each latch circuit 11. The level shifters 3 include control circuits 231 (231*a* to 231*l*, . . . ), switching circuits 232 (232*a* to 232*l*, . . . ) consisting of p-channel transistors or the like and level conversion circuits 233 (233*a* to 233*l*, . . . ). Each switching circuit 232 is an example of the "first switching circuit" according to the present invention.

Inputs and outputs of the latch circuits 11 are connected to the control circuits 231 respectively. As shown in FIG. 6, each control circuit 231 is formed by a NAND circuit 2313 and NOT circuits 2311, 2312 and 2314. When an input signal D1 in each latch circuit 11 goes high, an output signal A from each control circuit 231 goes low in operation, as shown in FIG. 7. When an output signal D2 from the latch circuit 11 goes low, the output signal A goes high. Each switching circuit 232 is turned on while the output signal A remains low. Thus, each level conversion circuit 233 is connected to a power supply voltage $V_{DD}$, for level-converting a low-voltage clock HCKL and outputting a horizontal clock HCK.

Operations of the signal line driving circuit 1 and the level shifter group 4 according to the second embodiment are now described. First, a horizontal start signal HST is input in the first-stage latch circuit 11*a* and the control circuit 231*a*. The horizontal start signal HST sets the latch circuit 11*a* and turns on the switching circuit 232*a*. Thus, the power supply voltage $V_{DD}$ is supplied to the level conversion circuit 233*a*, which in turn outputs the level-converted horizontal clock HCK to the latch circuit 11*a*. Therefore, the output of the latch circuit 11*a* goes high for a period corresponding to a desired cycle of the horizontal clock HCK responsive to the pulse width of the horizontal start signal HST. The RGB selection circuit 12*a* connects video signal lines 300R, 300G and 300B and signal lines 6Ra, 6Ga and 6Ba with each other respectively in response to an output from the latch circuit 11*a*. Thus, video signals are supplied to the signal lines 6Ra, 6Ga and 6Ba.

The output of the first-stage latch circuit 11*a* is input in the control circuit 231*a*, the second-stage latch circuit 11*b* and the control circuit 231*b*. An output of the control circuit 231*a* goes high when the output of the latch circuit 11*a* goes low. Thus, the switching circuit 232*a* is turned off to stop the operation of the level shifter 3*a*. At the same time, the output of the control circuit 231*b* goes low to turn on the switching circuit 232*b*, whereby the level shifter 3*b* starts operation. The second-stage latch circuit 11*b* is set by the output of the first-stage latch circuit 11*a*. Therefore, the horizontal clock HCK is so supplied that an output of the latch circuit 11*b* shifts from the output of the latch circuit 11*a* by half the cycle of the horizontal clock HCK, and goes low for a period of a desired cycle of the horizontal clock HCK. Thus, the video signals of the video signal lines 300R, 300G and 300B are supplied to signal lines 6Rb, 6Gb and 6Bb. The output of the second-stage latch circuit 11*b* stops the level shifter 3*b* thereof while operating the third-stage level shifter 3*c*.

Thereafter the subsequent level shifters 3 operate by outputs of the precedent latch circuits 11. Thus, the video signals are supplied to the signal lines 6. The outputs of the latch circuits 11 stop the level shifters 3 thereof. This operation is repeated for sequentially selecting the signal lines 6 and supplying the video signals to all pixels.

According to the second embodiment, each level shifter 3 is arranged for each latch circuit 11 for starting and terminating operation in response to the input and the output of the corresponding latch circuit 11 respectively. In other words, the level shifters 3 operate in a time-divisional manner so that each level shifter 3 starts operation simultaneously with termination of the operation of the immediately preceding level shifter 3 and terminates the operation simultaneously with initiation of the operation of the subsequent level shifter 3. The level shifters 3 and the latch circuits 11 are connected in one-to-one correspondence to each other, and hence only a single latch circuit 11 is in an operating state. Therefore, power consumption can be further reduced as compared with the aforementioned first embodiment.

The level shifters 3 are arranged in one-to-one correspondence to the latch circuits 11, whereby necessary numbers of the level shifters 3 and the latch circuits 11 may be added also when the number of the signal lines 6 or the scanning lines 7 is increased. Therefore, the design period can be reduced.

Third Embodiment

Figure 8:
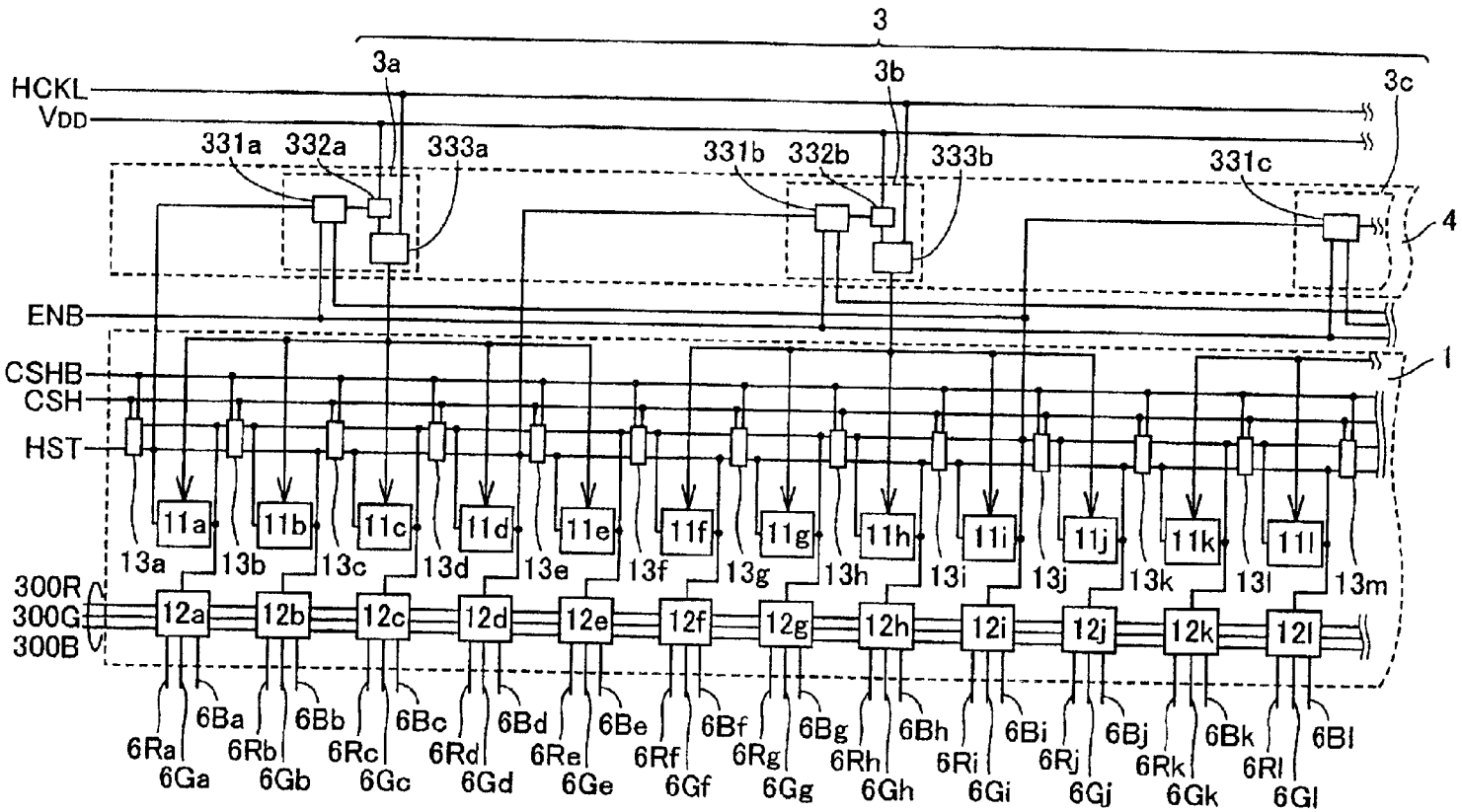
FIG. 8 is a circuit diagram showing a signal line driving circuit and a level shifter group in an active matrix display according to a third embodiment of the present invention.
Figure 9:
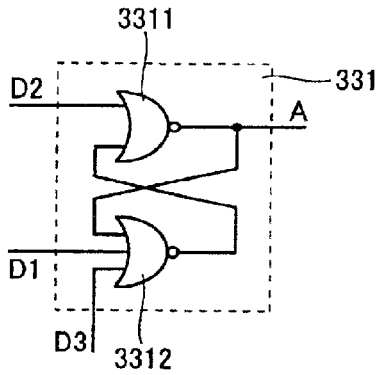
FIG. 9 is a circuit diagram showing the structure of a control circuit of a level shifter according to the third embodiment shown in FIG. 8.
Figure 10:
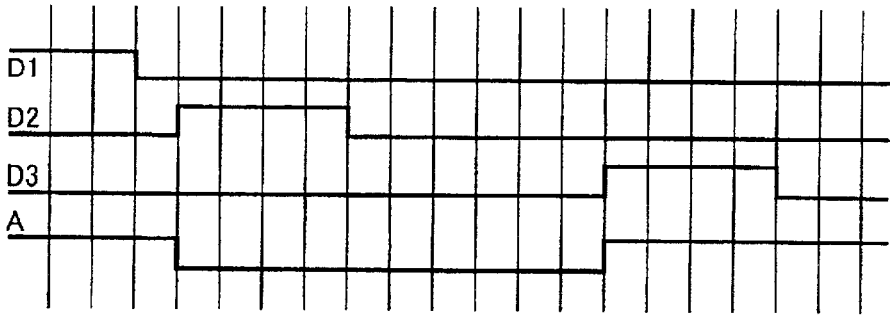
FIG. 10 is a timing chart for illustrating operations of the control circuit according to the third embodiment shown in FIG. 9.

Referring to FIGS. 8 to 10, each level shifter 3 is arranged in correspondence to five latch circuits 11 in an active matrix display according to a third embodiment of the present invention, similarly to the first embodiment. Dissimilarly to the first embodiment, however, a control circuit 331 forming the level shifter 3 is formed by a flip-flop circuit. The structure of the third embodiment is now described in detail.

According to the third embodiment, a level shifter group 4 is formed by a plurality of level shifters 3 (3*a*, 3*b*, 3*c*, . . . ). A signal line driving circuit 1 has a plurality of latch circuits 11 (11*a* to 11*l*, . . . ), a plurality of RGB selection circuits 12 (12*a* to 12*l*, . . . ) and a plurality of scanning direction selector switches 13 (13*a* to 13*m*, . . . ). According to the third embodiment, each of control circuits 331 (331*a*, 331*b*, 331*c*, . . . ) is connected with an output of a latch circuit 11 preceding the first-stage latch circuit 11 of a block including the level shifter 3 corresponding thereto by two stages, an output of a latch circuit 11 succeeding the final-stage latch circuit 11 by two stages and an ENB signal line for deciding an initial state input from an external control circuit 200.

As shown in FIG. 9, each control circuit 331 is formed by a flip-flop circuit consisting of NOR circuits 3311 and 3312.

In operation, a signal D1 is high, signals D2 and D3 are low and an output signal A from the control circuit 331 is high as the initial states, as shown in FIG. 10. The initial state of the output of the flip-flop circuit, which is undefined in general, is decided when the signal D1 (ENB) is set high in the initial state as described above.

When the signal D1 goes low and thereafter the signal D2 output from the latch circuit 11 goes high, the output signal A goes low. The output signal A keeps the low level until the signal D3 goes high. While the output signal A remains low, a switching circuit 332 consisting of a p-channel transistor or the like enters an ON state. In this state, a level conversion circuit 333 is connected to a power supply voltage $V_{DD}$, for level-converting a low-voltage clock HCKL and outputting a horizontal clock HCK. The switching circuit 332 is an example of the "first switching circuit" according to the present invention.

Operations of the signal line driving circuit 1 and the level shifter group 4 according to the third embodiment are now described. First, a horizontal start signal HST is input in the first-stage latch circuit 11*a* and the control circuit 331*a*. The horizontal start signal HST sets the latch circuit 11*a* and turns on the switching circuit 332*a*. Therefore, the power supply voltage $V_{DD}$ is supplied to the level conversion circuit 333*a*, which in turn outputs a level-converted horizontal clock HCK to the latch circuit 11*a*. Thus, the output of the latch circuit 11*a* goes low for a period of a desired cycle of the horizontal clock HCK responsive to the pulse width of the horizontal start signal HST. In response to an output of the latch circuit 11*a*, the RGB selection circuit 12*a* connects video signal lines 300R, 300G and 300B and signal lines 6Ra, 6Ga and 6Ba respectively. Thus, video signals are supplied to the signal lines 6Ra, 6Ga and 6Ba.

The output of the first-stage latch circuit 11*a* is input in the second-stage latch circuit 11*b*. The second-stage latch circuit 11*b* is set by the output of the first-stage latch circuit 11*a*. Thus, the horizontal clock HCK is so supplied that an output of the latch circuit 11*b* shifts from the output of the latch circuit 11*a* by half the cycle of the horizontal clock HCK and goes high for a period of a desired cycle of the horizontal clock HCK. Thus, the video signals of the video signal lines 300R, 300G and 300B are supplied to signal lines 6Rb, 6Gb and 6Bb respectively.

The output of the second-stage latch circuit 11*b* is input in the third-stage latch circuit 11*c*, so that the video signals of the video signal lines 300R, 300G and 300R are supplied to signal lines 6RC, 6Gc and 6Bc respectively. An output of the third-stage latch circuit 11*c* is input in the fourth-stage latch circuit lid, so that the video signals of the video signal lines 300R, 300G and 300B are supplied to signal lines 6Rd, 6Gd and 6Bd respectively. An output of the fourth-stage latch circuit 11*d* is input in the fifth-stage latch circuit 11*e*, so that the video signals of the video signal lines 300R, 300G and 300G are supplied to signal lines 6Re, 6Ge and 6Be respectively. An output signal D2 from the fourth-stage latch circuit 11*d* is input in the control circuit 331*b* of the level shifter 3*b* of the subsequent block. Thus, the level shifter 3*b* starts operation.

An output of the fifth-stage latch circuit 11*e* is input in the first-stage latch circuit 11*f* of the subsequent block. The level shifter 3*b* already starts operation at this time, and hence the latch circuit 11*f* shifts by half the cycle of the horizontal clock HCK without a delay and goes high for a desired period. Thus, the video signals of the video signal lines 300R, 300G and 300B are supplied to signal lines 6Rf, 6Gf and 6Bf. An output of the first-stage latch circuit 11*f* is input in the second-stage latch circuit 11*g*, so that the video signals of the video signal lines 300R, 300G and 300B are supplied to signal lines 6Rg, 6Gg and 6Bg respectively. An output of the second-stage latch circuit 11*g* is input in the third-stage latch circuit 11*h*, so that the video signals of the video signal lines 300R, 300G and 300B are supplied to signal lines 6Rh, 6Gh and 6Bh respectively. An output of the third-stage latch circuit 11*h* is input in the fourth-stage latch circuit 11*i*, so that the video signals of the video signal lines 300R, 300G and 300B are supplied to signal lines 6Ri, 6Gi and 6Bi. An output signal D3 from the fourth-stage latch circuit 11*i* is input in the control circuit 331*a* of the level shifter 3*a* of the preceding block. When this signal D3 goes high, the operation of the level shifter 3*a* of the preceding block is terminated. The output signal D3 from the latch circuit 11*i* is also input in the control circuit 331*c* of the level shifter 3*c* of the succeeding block. Thus, the level shifter 3*c* starts operation.

Thereafter the latch circuits 11 sequentially output signals while shifting the same in response to the horizontal clock HCK, and supply the video signals to the signal lines 6R, 6G and 6B. The output of each fourth-stage latch circuit 11 is input not only in the next-stage latch circuit 11 but also in the control circuits 331 of the level shifters 3 of the preceding and succeeding blocks for starting or terminating operations of the level shifters 3. This is repeated for sequentially selecting the signal lines 6 and supplying the video signals to all pixels.

Each level shifter 3 according to the third embodiment operates for a period substantially similar to that of each level shifter 3 according to the aforementioned first embodiment, and hence power consumption in the active matrix display according to the third embodiment is equivalent to that in the active matrix display according to the first embodiment. Therefore, the third embodiment attains a large effect of reducing power consumption.

According to the third embodiment, the signal ENB (D1) deciding the initial state must be externally input in each control circuit 331. However, each control circuit 331 requires only signals for starting and terminating the operation as those necessary for controlling the operating period, and hence the number of elements forming the control circuit 331 as well as the number of wires for the control circuits 331 can be reduced. Thus, the design of the active matrix display is simplified.

Further, the active matrix display according to the third embodiment requires no signals for maintaining control signals, and hence no operation failure results from signals input for maintaining the control signals.

Fourth Embodiment

Figure 11:
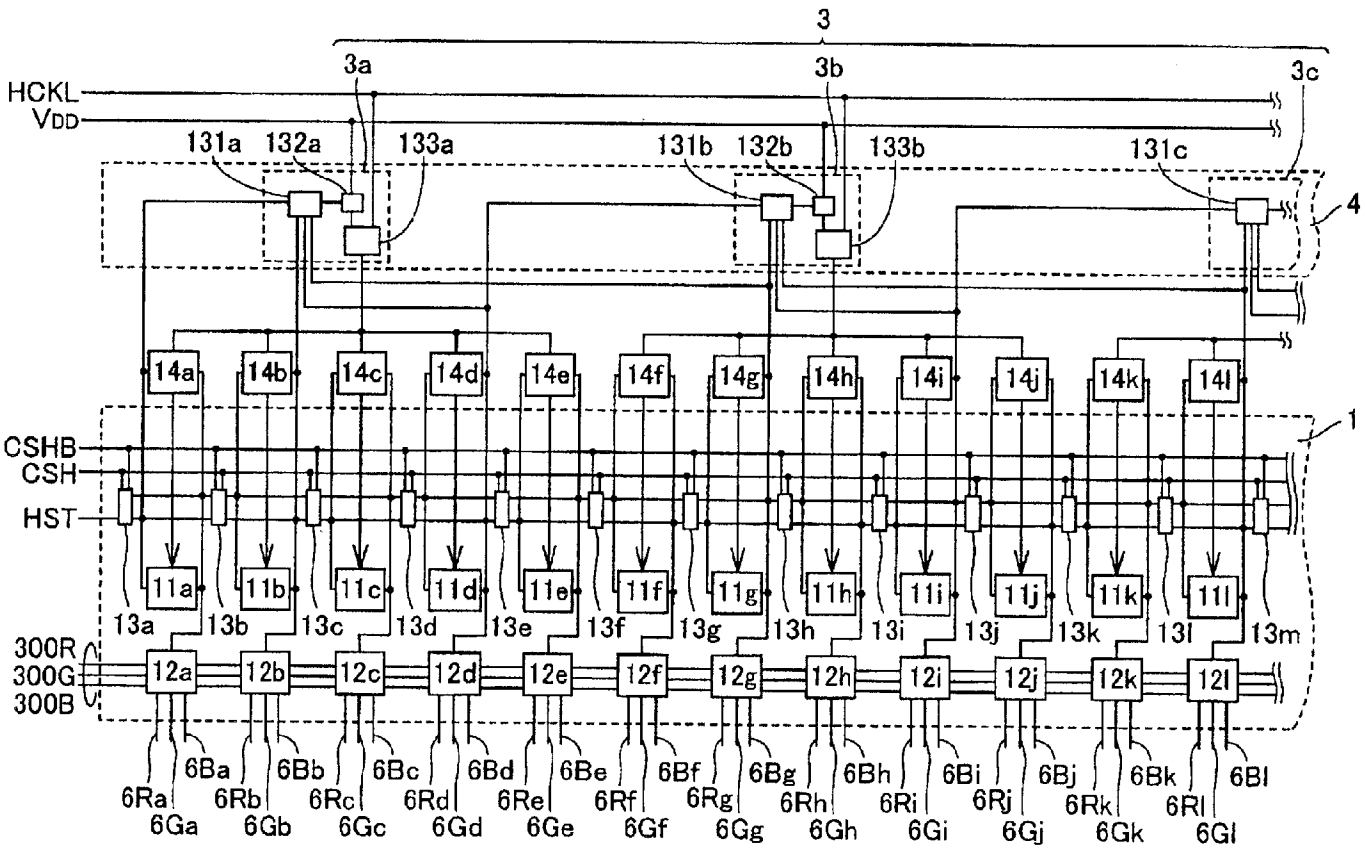
FIG. 11 is a circuit diagram showing a signal line driving circuit and a level shifter group in an active matrix display according to a fourth embodiment of the present invention.

Referring to FIG. 11, each level shifter 3 is arranged in correspondence to five latch circuits 11 in an active matrix display according to a fourth embodiment of the present invention, similarly to the first embodiment. According to the fourth embodiment, however, a switching circuit 14 is connected to each output from the level shifter 3 to the latch circuits 11, dissimilarly to the first embodiment. The active matrix display according the fourth embodiment is now described in detail.

According to the fourth embodiment, a level shifter group 4 and a signal line driving circuit 1 are similar in structure to those of the aforementioned first embodiment. The feature of the fourth embodiment resides in that switching circuits 14 (14*a* to 14*l*, . . . ) are provided on the respective outputs from the level shifters 3 to the latch circuits 11 in a structure similar to that of the active matrix display according to the first embodiment shown in FIG. 2. In other words, the switching circuits 14 are provided between the level shifters 3 and the latch circuits 11 according to the fourth embodiment. Each switching circuit 14, including a CMOS switch circuit, an inverter circuit and a NOR circuit, for example, is connected to inputs and outputs of the latch circuits 11. Each switching circuit 14 is an example of the "second switching circuit" according to the present invention.

The basic operation of the active matrix display including the switching circuits 14 according to the fourth embodiment is similar to that of the first embodiment shown in FIG. 2. In operation of each switching circuit 14 according to the fourth embodiment, the switching circuit 14 is turned on when an input signal in the latch circuit 11 goes high from a low level, and turned off when an output signal from the latch circuit 11 goes low from a high level. A signal level-converted by a level shifter 3 is supplied to the latch circuit 11 only in an ON-period of the switching circuit 14.

According to the fourth embodiment, the switching circuits 14 are provided between the level shifters 3 and the latch circuits 11 as hereinabove described, whereby level-converted output signals from the level shifters 3 can be input in the latch circuits 11 only when the same operate. Thus, power consumed by the latch circuits 11 operating only at necessary times can be reduced. Consequently, power consumption can be further reduced in addition to the effect of reducing power consumption according to the aforementioned first embodiment.

Fifth Embodiment

Figure 12:
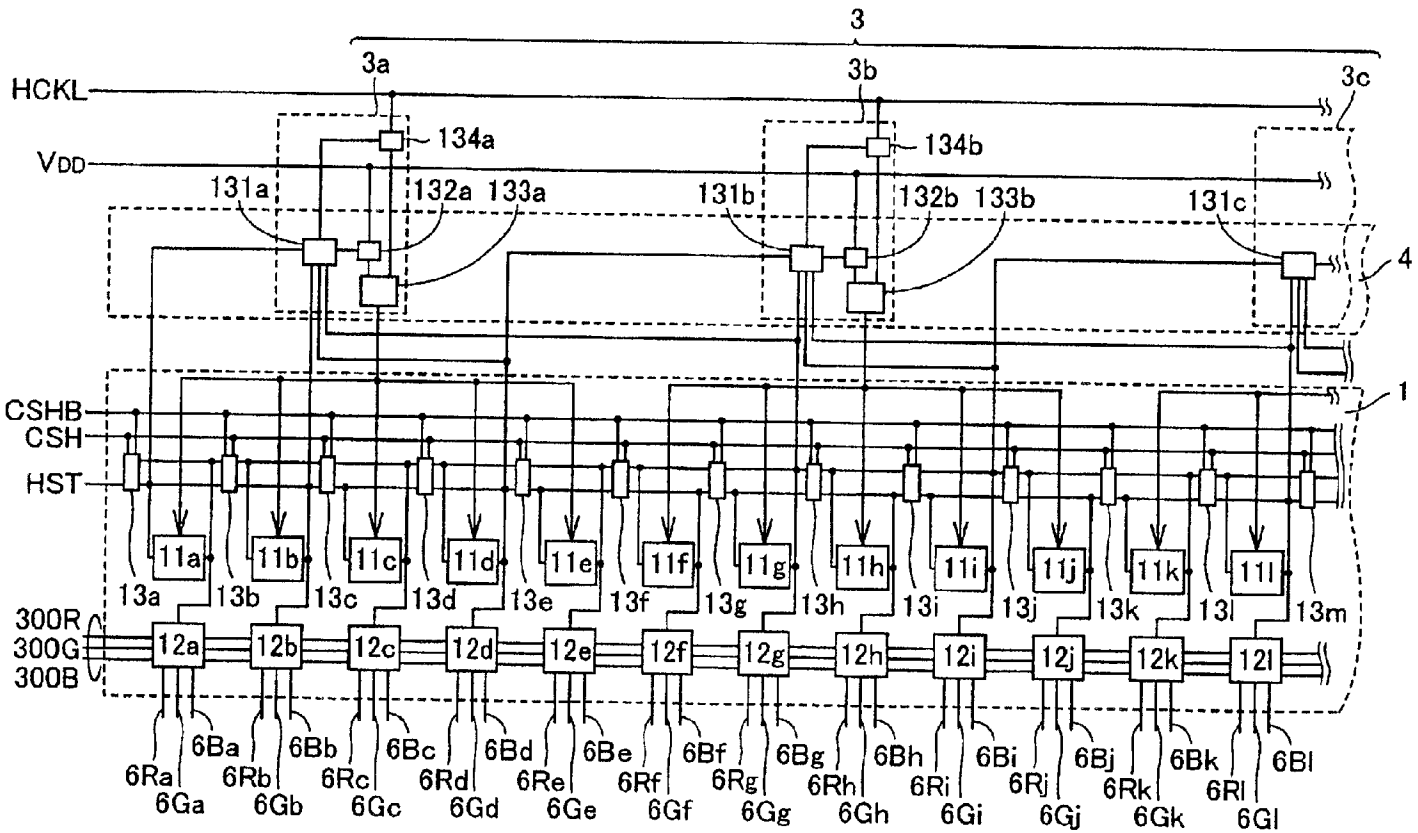
FIG. 12 is a circuit diagram showing a signal line driving circuit and a level shifter group in an active matrix display according to a fifth embodiment of the present invention.

Referring to FIG. 12, each level shifter 3 is arranged in correspondence to five latch circuits 11 in an active matrix display according to a fifth embodiment of the present invention, similarly to the first embodiment. According to the fifth embodiment, however, a switching circuit is newly added for supplying a low-voltage clock HCKL to each level shifter 3 in response to a control signal from a control circuit 131, dissimilarly to the first embodiment. The active matrix display according to the fifth embodiment is now described in detail.

According to the fifth embodiment, a level shifter group 4 is formed by a plurality of level shifters 3 (3*a*, 3*b*, 3*c*, . . . ), similarly to the first embodiment. The level shifters 3 according to the fifth embodiment have switching circuits 134 (134*a*, 134*b*, . . . ) in addition to control circuits 131 (131*a*, 131*b*, 131*c*, . . . ) switching circuits 132 (132*a*, 132*b*, . . . ) consisting of p-channel transistors or the like and level conversion circuits 133*a*, 133*b*, . . . ). Each switching circuit 134 includes a COMS switch and an inverter circuit, for example. Each switching circuit 134 is an example of the "third switching circuit" according to the present invention. The switching circuits 134 are connected to the control circuits 131, a low-voltage clock line HCKL and the level conversion circuits 133. The switching circuits 134 are turned on/off by control signals (output signals) from the control circuits 131.

The basic operation of the active matrix display including the switching circuits 134 according to the fifth embodiment is similar to that of the first embodiment shown in FIG. 2. Each switching circuit 134 enters an ON state while the output signal (control signal) from the control circuit 131 is low, similarly to each switching circuit 132. While the switching circuit 134 is in the ON state, the low-voltage clock HCKL is supplied to the level conversion circuit 133.

According to the fifth embodiment, the switching circuit 134 supplying the low-voltage clock HCKL to the level conversion circuit 133 in response to the control signal from the control circuit 131 is added to each level shifter 3 as hereinabove described, whereby the low-voltage clock HCKL can be captured only for a necessary period through the switching circuit 134. Thus, a charge/discharge current generated in a portion where a line supplying the low-voltage clock HCKL which is a clock signal to the level conversion circuit 133 and a power supply $V_{DD}$ line can be reduced. Consequently, power consumption can be further reduced in addition to the effect of reducing power consumption according to the first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while each of the above embodiments has been described with reference to an active matrix LCD, the present invention is not restricted to this but is also applicable to various active matrix displays such as an active matrix EL display, a plasma display, an FED and an electrophoretic display.

While the structure of the level shifter group 4 closer to the signal line driving circuit 1 has been described in each of the above embodiments, the level shifter group 5 closer to the scanning line driving circuit 2 has a structure similar to that of the level shifter group 4 according to any of the aforementioned first to fifth embodiments.

While the low-voltage clock HCKL is supplied to each level shifter 3 in each of the aforementioned embodiments, the present invention is not restricted to this but signals HCKL and HCKLB (inverted signal of the signal HCKL) may alternatively be supplied to the level shifter 3 in place of the low-voltage clock HCKL.

The control circuits 134 according to the aforementioned fifth embodiment are also applicable to each of the first to fourth embodiments. Also in this case, an effect similar to that of the fifth embodiment can be attained.

While each switching circuit 14 is turned on and off by the input signal in and the output signal from the latch circuit 11 respectively in the aforementioned fourth embodiment, the present invention is not restricted to this but each switching circuit 14 may alternatively be turned on by an input signal in the latch circuit 11 preceding the corresponding latch circuit 11. Further, the switching circuit 14 may be turned off by a signal succeeding the output signal from the corresponding latch circuit 11. However, the operating period of the switching circuit 14 must be set shorter than that of the level shifter 3 arranged in a dispersed manner.

What is claimed is:

1. An active matrix display comprising:

a plurality of pixel electrodes arranged in the form of a matrix;

a plurality of scanning lines arranged in a row direction;

a plurality of signal lines arranged in a column direction:

a plurality of switching elements having gate electrodes and drain or source electrodes connected to said scanning lines and said signal lines respectively;

a signal line driving circuit sequentially selecting prescribed scanning lines from said plurality of scanning lines and supplying a video signal;

a scanning line driving circuit sequentially selecting prescribed scanning lines from said plurality of scanning lines and supplying a scanning signal; and a level shifter group including a plurality of level shifters connected to at least either said signal line driving circuit or said scanning line driving circuit for operating in a time-divisional manner, wherein each said level shifter forming said level shifter group includes:

a level conversion circuit converting a signal voltage level, a control circuit generating a control signal deciding an operating period of said level shifter, and a first switching circuit supplying a power supply voltage to said level conversion circuit in response to said control signal, at least either said signal driving circuit or said scanning line driving circuit has a shift register consisting of a plurality of latch circuits, and a plurality of said latch circuits are associatively connected to each said level shifter forming said level shifter group each said level shifter forming said level shifter group starts operation before operation initiation of said latch circuits associatively connected thereto and terminates the operation before operation termination of said latch circuit.

2. The active matrix display according to claim 1, wherein said lever shifter group including said plurality of level shifters operating in a time-divisional manner is connected to both of said signal line driving circuit and said scanning line driving circuit.

3. The active matrix display according to claim 1, including either an active matrix liquid crystal display or an active matrix EL display.

4. An active matrix display comprising:

a plurality of pixel electrodes arranged in the form of a matrix;

a plurality of scanning lines arranged in a row direction;

a plurality of signal lines arranged in a column direction;

a plurality of switching elements having gate electrodes and drain or source electrodes connected to said scanning lines and said signal lines respectively;

a signal line driving circuit sequentially selecting prescribed scanning lines from said plurality of scanning lines and supplying a video signal;

a scanning line driving circuit sequentially selecting prescribed scanning lines from said plurality of scanning lines and supplying a scanning signal; and a level shifter group including a plurality of level shifters connected to at least either said signal line driving circuit or said scanning line driving circuit for operating in a time-divisional manner, wherein each said level shifter forming said level shifter group includes:

a level conversion circuit converting a signal voltage level, a control circuit generating a control signal deciding an operating period of said level shifter, and a first switching circuit supplying a power supply voltage to said level conversion circuit in response to said control signal, at least either said signal driving circuit or said scanning line driving circuit has a shift register consisting of a plurality of latch circuits, and a plurality of said latch circuits are associatively connected to each said level shifter forming said level shifter group said control circuit receives output signals from a plurality of said latch circuits thereby generating said control signal deciding said operating period of each said level shifter forming said level shifter group.

5. The active matrix display according to claim 4, wherein said control circuit receives an output signal from a latch circuit preceding the initial-stage latch circuit among a plurality of said latch circuits associatively connected to each level shifter forming said level shifter group by at least two stages and an output signal from a latch circuit succeeding the final-stage latch circuit.

6. The active matrix display according to claim 5, wherein each said level shifter is provided for five said latch circuits, and said control circuit receives outputs from second- and fourth-stage latch circuits of a block including said level shifter, a fourth-stage latch circuit of a block immediately preceding said block and a second-stage latch circuit of a block immediately succeeding said block.

7. The active matrix display according to claim 6, wherein each said level shifter starts operation in response to said output from said fourth-stage latch circuit of said immediately preceding block, maintains the operation in response to said outputs from said second- and fourth-stage latch circuits of said block including said level shifter and terminates the operation in response to said output from said second-stage latch circuit of said immediately succeeding block.

8. The active matrix display according to claim 4, wherein said output signals of said latch circuits input in said control circuit are output signals from the same latch circuits regardless of a scanning direction.

9. The active matrix display according to claim 4, wherein said control circuit receives output signals from one or a plurality of latch circuits among a plurality of said latch circuits associatively connected to each said level shifter for maintaining said control signal during said operating period of said level shifter.

10. The active matrix display according to claim 4, wherein said control circuit includes a flip-flop circuit.

11. The active matrix display according to claim 10, wherein an ENB signal line for deciding an initial state is connected to said control circuit.

12. The active matrix display according to claim 10, wherein each said level shifter is provided for five said latch circuits, and said control circuit receives outputs from a fourth-stage latch circuit of a block immediately preceding a block including said level shifter and a fourth-stage latch circuit of a block immediately succeeding said block including said level shifter.

13. The active matrix display according to claim 4, wherein said control circuit includes a NOR circuit, a NOT circuit and a NAND circuit.

14. The active matrix display according to claim 4, wherein said level shifter group including said plurality of level shifters operating in a time-divisional manner is connected to both of said signal line driving circuit and said scanning line driving circuit.

15. An active matrix display comprising:

a plurality of pixel electrodes arranged in the form of a matrix;

a plurality of scanning lines arranged in a row direction;

a plurality of signal lines arranged in a column direction;

a plurality of switching elements having gate electrodes and drain or source electrodes connected to said scanning lines and said signal lines respectively;

a signal line driving circuit sequentially selecting prescribed scanning lines from said plurality of scanning lines and supplying a video signal;

a scanning line driving circuit sequentially selecting prescribed scanning lines from said plurality of scanning lines and supplying a scanning signal; and a level shifter group including a plurality of level shifters connected to at least either said signal line driving circuit or said scanning line driving circuit for operating in a time-divisional manner, wherein each said level shifter forming said level shifter group includes:

a level conversion circuit converting a signal voltage level.

a control circuit generating a control signal deciding an operating period of said level shifter, and a first switching circuit supplying a power supply voltage to said level conversion circuit in response to said control signal, at least either said signal line driving circuit or said scanning line driving circuit has a shift register consisting of a plurality of latch circuits, and each said latch circuit is connected in one-to-one correspondence to each said level shifter forming said level shifter group.

each said level shifter forming said level shifter group starts operation simultaneously with operation initiation of said latch circuit connected in correspondence thereto and terminates the operation simultaneously with operation termination of said latch circuit.

16. The active matrix display according to claim 15, wherein said control circuit includes a NOT circuit and a NAND circuit.

17. An active matrix display comprising:

a plurality of pixel electrodes arranged in the form of a matrix;

a plurality of scanning lines arranged in a row direction;

a plurality of signal lines arranged in a column direction;

a plurality of switching elements having gate electrodes and drain or source electrodes connected to said scanning lines and said signal lines respectively;

a signal line driving circuit sequentially selecting prescribed scanning lines from said plurality of scanning lines and supplying a video signal;

a scanning line driving circuit sequentially selecting prescribed scanning lines from said plurality of scanning lines and supplyina a scanning signal: and a level shifter group including a plurality of level shifters connected to at least either said signal line driving circuit or said scanning line driving circuit for operating in a time-divisional manner, wherein each said level shifter forming said level shifter group includes:

a level conversion circuit converting a signal voltage level, a control circuit generating a control signal deciding an operating period of said level shifter, and a first switching circuit supplyina a power supply voltage to said level conversion circuit in response to said control signal, at least either said signal line driving circuit or said scanning line driving circuit has a shift register consisting of a plurality of latch circuits, and a plurality of said latch circuits are associatively connected to each of said level shifters forming said level shifter group, said active matrix display further comprising a second switching circuit connected to each output from each said level shifter to each said latch circuit.

18. An active matrix display comprising:

a plurality of pixel electrodes arranged in the form of a matrix;

a plurality of scanning lines arranged in a row direction;

a plurality of signal lines arranged in a column direction;

a plurality of switching elements having gate electrodes and drain or source electrodes connected to said scanning lines and said signal lines respectively;

a signal line driving circuit sequentially selecting prescribed scanning lines from said plurality of scanning lines and supplyina a video signal;

a scanning line driving circuit sequentially selecting prescribed scanning lines from said plurality of scanning lines and supplying a scanning signal; and a level shifter group including a plurality of level shifters connected to at least either said signal line driving circuit or said scanning line driving circuit for operating in a time-divisional manner, wherein each said level shifter forming said level shifter group includes;

a level conversion circuit converting a signal voltage level, a control circuit generating a control signal deciding an operating period of said level shifter, and a first switching circuit supplyina a power supply voltage to said level conversion circuit in response to said control signal, said level shifters forming said level shifter group further include a third switching circuit connected to a signal line for supplying a signal from said signal line to said level conversion circuit in response to a control signal from said control circuit.

* * * * *